US011441364B2

(12) United States Patent
DeBoer

(10) Patent No.: US 11,441,364 B2
(45) Date of Patent: Sep. 13, 2022

(54) CONCENTRIC PIPE SYSTEMS AND METHODS

(71) Applicant: Kryn Petroleum Services LLC, Richmond, TX (US)

(72) Inventor: Luc DeBoer, Richmond, TX (US)

(73) Assignee: Kryn Petroleum Services LLC, Richmond, TX (US)

( * ) Notice: Subject to any disclaimer, the term of this patent is extended or adjusted under 35 U.S.C. 154(b) by 0 days.

(21) Appl. No.: 17/112,774

(22) Filed: Dec. 4, 2020

(65) Prior Publication Data

US 2021/0087891 A1 Mar. 25, 2021

Related U.S. Application Data

(63) Continuation of application No. 16/348,334, filed as application No. PCT/US2017/060635 on Nov. 8, 2017, now Pat. No. 10,865,607.

(60) Provisional application No. 62/419,292, filed on Nov. 8, 2016.

(51) Int. Cl.

| | |
|---|---|
| ***E21B 17/18*** | (2006.01) |
| ***E21B 17/20*** | (2006.01) |
| ***E21B 21/10*** | (2006.01) |
| ***E21B 21/12*** | (2006.01) |
| ***E21B 33/038*** | (2006.01) |

(52) U.S. Cl.

CPC ..... *E21B 17/18* (2013.01); *E21B 17/20* (2013.01); *E21B 21/103* (2013.01); *E21B 21/12* (2013.01); *E21B 33/038* (2013.01); *E21B 2200/04* (2020.05)

(58) Field of Classification Search

CPC ..... E21B 17/18; E21B 17/20; E21B 21/103; E21B 21/12; E21B 2200/04; E21B 33/038

See application file for complete search history.

(56) References Cited

U.S. PATENT DOCUMENTS 4,768,598 A * 9/1988 Reinhardt ..... E21B 4/02 175/107

2011/0042097 A1* 2/2011 Stephenson ..... E21B 17/18 166/105

* cited by examiner

*Primary Examiner* — James G Sayre

(74) *Attorney, Agent, or Firm* — Conley Rose, P.C.

(57) ABSTRACT

A concentric valve positionable in a wellbore includes a valve body including an outer surface and a central passage, a receptacle disposed in the central passage and defining a chamber disposed therein, and a radial port extending between the receptacle and the outer surface to provide fluid communication between the chamber of the receptacle and an environment surrounding the concentric valve, an inner tubular member received in the receptacle of the valve body, wherein the inner tubular member includes a seal assembly configured to sealingly engage an inner surface of the receptacle, and a bypass passage extending around the receptacle of the valve body and circumferentially spaced from the radial port, wherein the bypass passage provides fluid communication between a first end of the central passage and a second end of the central passage opposite the first end.

19 Claims, 10 Drawing Sheets

CONCENTRIC PIPE SYSTEMS AND METHODS

CROSS-REFERENCE TO RELATED APPLICATIONS

This application is a continuation of U.S. application Ser. No. 16/348,334 filed May 8, 2019, and entitled "Concentric Pipe Systems and Methods," which is a 35 U.S.C. § 371 national stage application of PCT/US2017/060635 filed Nov. 8, 2017, and entitled "Concentric Pipe Systems and Methods," which claims benefit of U.S. provisional patent application No. 62/419,292 filed Nov. 8, 2016, and entitled "Concentric Pipe Systems and Methods," each of which is hereby incorporated herein by reference in its entirety.

STATEMENT REGARDING FEDERALLY SPONSORED RESEARCH OR DEVELOPMENT

Not applicable.

BACKGROUND

Well systems include a wellbore or well extending into a subterranean, hydrocarbon bearing formation. The well of offshore well systems extends from a sea floor and may include a wellhead mounted at the surface of the subsea well for providing access to the well and for supporting equipment of the well system mounted thereto. In some applications, a marine riser extends between a blowout preventer (BOP) coupled to the wellhead at the sea floor and a rig or platform disposed at the sea surface, where the riser provides a conduit for a string, such as a drill string, to extend from the rig into the wellbore, as well as an annulus conduit for circulating fluids to the rig from the wellbore. In other offshore applications, a riserless system may be employed that uses a concentric string or concentric drill pipe (CDP) for conveying fluids to and from the wellbore in lieu of riser. In these applications, the CDP extends from the rig to a location at or near a drill bit coupled to the CDP, and provides multiple passages (an inner bore with a surrounding annulus) for conveying fluids to and from the wellbore.

BRIEF SUMMARY OF THE DISCLOSURE

An embodiment of a concentric valve positionable in a wellbore comprises a valve body comprising an outer surface and a central passage, a receptacle disposed in the central passage and defining a chamber disposed therein, and a radial port extending between the receptacle and the outer surface to provide fluid communication between the chamber of the receptacle and an environment surrounding the concentric valve, an inner tubular member received in the receptacle of the valve body, wherein the inner tubular member comprises a seal assembly configured to sealingly engage an inner surface of the receptacle; and a bypass passage extending around the receptacle of the valve body and circumferentially spaced from the radial port, wherein the bypass passage provides fluid communication between a first end of the central passage and a second end of the central passage opposite the first end. In some embodiments, the concentric valve further comprises a piston slidably disposed in the receptacle of the valve body, wherein the piston comprises a first position providing for fluid communication between the chamber of the valve body and the surrounding environment, and a second position restricting fluid communication between the surrounding environment and the chamber. In some embodiments, the concentric valve further comprises a biasing member configured to bias the piston towards the second position. In certain embodiments, the piston is configured to actuate into the second position in response to the ceasing of fluid flow along the inlet flowpath. In certain embodiments, the piston comprises a radial port in fluid communication with the radial port of the valve body when the piston is in the first position. In some embodiments, the concentric valve comprises a plurality of the bypass passages which are circumferentially spaced from each other and the radial port. In some embodiments, fluid communication is restricted between the bypass passage and the radial port.

An embodiment of a concentric valve positionable in a wellbore comprises a valve body comprising an outer surface and a central passage, a receptacle disposed in the central passage and defining a chamber disposed therein, and a radial port extending between the receptacle and the outer surface to provide fluid communication between the chamber of the receptacle and an environment surrounding the concentric valve; an inner tubular member slidingly received in the receptacle of the valve body whereby an outer surface of the inner tubular member is unattached from an inner surface of the receptacle, wherein the inner tubular member comprises a seal assembly configured to sealingly engage an inner surface of the receptacle; and a piston slidably disposed in the receptacle of the valve body, wherein the piston comprises a first position providing for fluid communication between the chamber of the valve body and the surrounding environment, and a second position restricting fluid communication between the surrounding environment and the chamber. In some embodiments, the concentric valve further comprises a bypass passage extending around the receptacle of the valve body, wherein the bypass passage provides fluid communication between a first end of the central passage and a second end of the central passage opposite the first end. In some embodiments, the bypass passage is circumferentially spaced from the radial port. In certain embodiments, the concentric valve further comprises a plurality of the bypass passages which are circumferentially spaced from each other and the radial port. In certain embodiments, the piston is configured to actuate into the first position in response to fluid pressure in the inlet flowpath extending through the bypass passage being greater than fluid pressure in a recirculation flowpath extending through the radial port. In some embodiments, the concentric valve further comprises a biasing member configured to bias the piston towards the second position. In some embodiments, the piston comprises a radial port in fluid communication with the radial port of the valve body when the piston is in the first position.

An embodiment of a concentric valve positionable in a wellbore comprises a valve body comprising an outer surface and a central passage, a receptacle disposed in the central passage and defining a chamber disposed therein, and a radial port extending between the receptacle and the outer surface to provide fluid communication between the chamber of the receptacle and an environment surrounding the concentric valve; an inner tubular member slidingly received in the receptacle of the valve body whereby an outer surface of the inner tubular member is unattached from an inner surface of the receptacle, wherein the inner tubular member comprises a seal assembly configured to sealingly engage an inner surface of the receptacle; and a bypass passage extending around the receptacle of the valve body configured to provide fluid communication between a first end of the central passage and a second end of the central passage opposite the first end. In some embodiments, the concentric valve further comprises a piston slidably disposed in the receptacle of the valve body, wherein the piston comprises a first position providing for fluid communication between the chamber of the valve body and the surrounding environment, and a second position restricting fluid communication between the surrounding environment and the chamber. In some embodiments, the piston is configured to actuate into the first position in response to fluid pressure in the inlet flowpath extending through the bypass passage being greater than fluid pressure in a recirculation flowpath extending through the radial port. In certain embodiments, the piston comprises a radial port in fluid communication with the radial port of the valve body when the piston is in the first position. In certain embodiments, the bypass passage is circumferentially spaced from the radial port. In some embodiments, fluid communication is restricted between the bypass passage and the radial port.

BRIEF DESCRIPTION OF THE DRAWINGS

For a detailed description of the various exemplary embodiments disclosed herein, reference will now be made to the accompanying drawings in which.

DETAILED DESCRIPTION OF EXEMPLARY EMBODIMENTS

Figure 1:
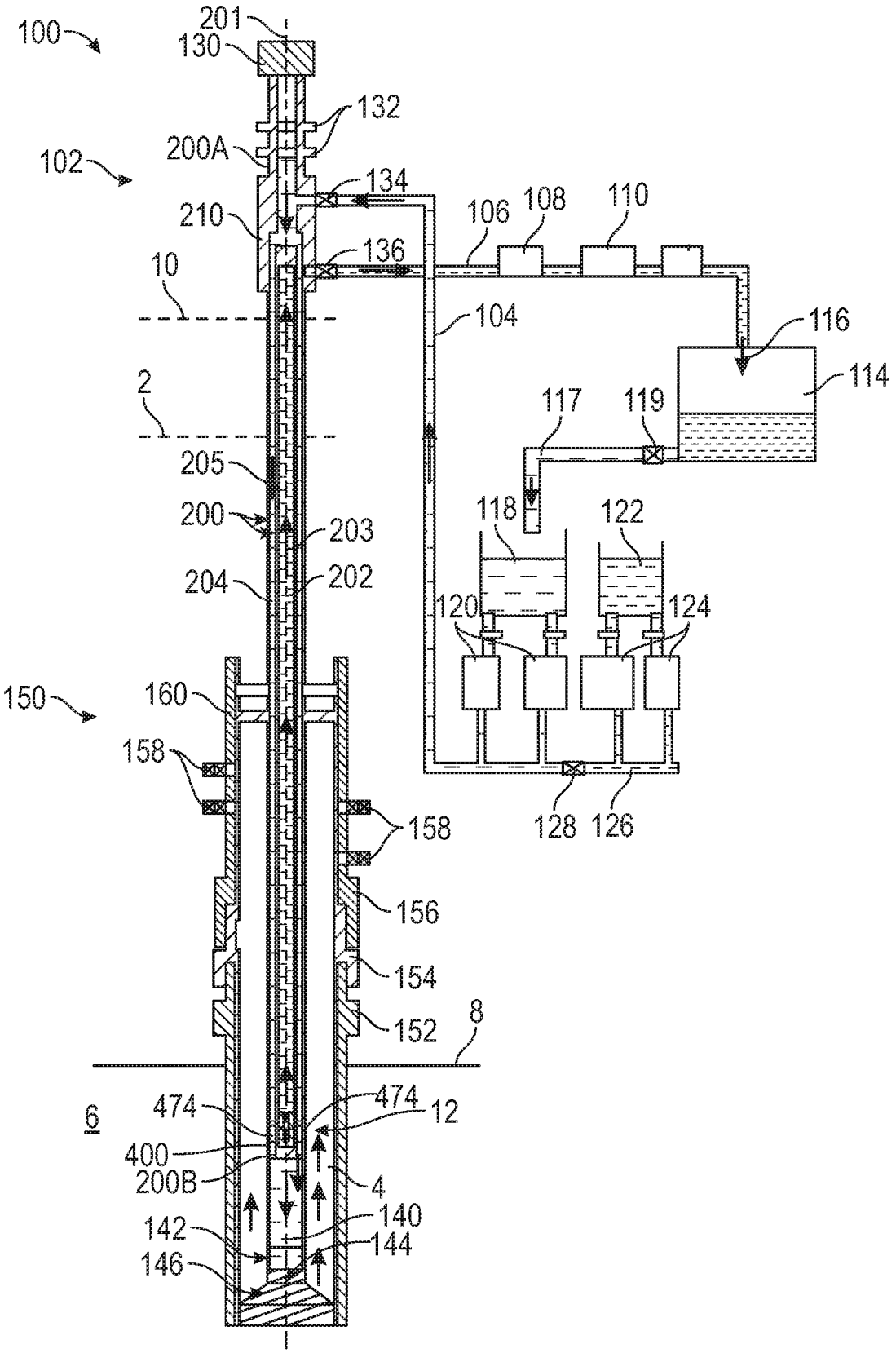
FIG. 1 is a schematic view of an embodiment of a well system in accordance with principles disclosed herein.

The drawing figures are not necessarily to scale. Certain features of the disclosure may be shown exaggerated in scale or in somewhat schematic form, and some details of conventional elements may not be shown, all in the interest of clarity and conciseness. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections.

The following discussion is directed to various embodiments of the disclosure. One skilled in the art will understand that the following description has broad application, and the discussion of any embodiment is meant only to be exemplary of that embodiment, and not intended to intimate that the scope of the disclosure, including the claims, is limited to that embodiment.

Referring to FIG. 1, an embodiment of a well or drilling system 100 is shown schematically. Drilling system 100 comprises a riserless offshore drilling system, or in other words, an offshore drilling system configured to circulate drilling fluids to and from a wellbore without needing a riser for conducting the drilling fluids. In the embodiment shown, drilling system 100 generally includes a surface system 102, a wellhead system 150, and a tubular assembly or drill string 200. In some embodiments, the components of surface system 102 are disposed at a surface or waterline on a vessel, such as a semi-submersible drilling vessel or drill ship. In the embodiment shown in FIG. 1, surface system 102 of drilling system 100 is disposed above a water line or sea level 2 and generally includes an inlet fluid conduit 104 for injecting or providing drilling fluids to a wellbore 4 extending into a subterranean earthen formation 6 from a sea floor 8, and a return fluid conduit 106 for returning drilling fluids from the wellbore 4.

In the embodiment shown in FIG. 1, return conduit 106 includes a choke manifold 108 for managing fluid pressure in return conduit 106, a degasser for removing gas from a fluid flow passing through conduit 106, and one or more shale shakers 110 for removing cuttings and other debris from fluid flowing through return conduit 106. The recirculated fluid flowing through return conduit 116 (indicated by arrow 116 in FIG. 1) is stored in one more storage tanks 114 disposed on a deck or rig floor 10 of the platform of drilling system 100. In the embodiment shown in FIG. 1, surface system 102 additionally includes a first drilling fluid tank 118 that receives fluid from storage tank 114 via a conduit 117 that includes a valve 119 for controlling fluid communication between tanks 118 and 114. First fluid tank 118 includes a pair of pumps 120 for providing pressurized first fluid from first tank 118 to inlet fluid conduit 104 for injection into drill string 200, as will be described further herein.

In the embodiment shown in FIG. 1, surface system 102 further includes a second drilling fluid tank 122 that is configured to provide pressurized second fluid therefrom to inlet fluid conduit 104 via a pair of pumps 124 and a conduit 126 in selective fluid communication with inlet conduit 104 via a valve 128. In some embodiments, the first fluid disposed in first tank 118 comprises a higher density than the second fluid disposed in second tank 122, where the density of the drilling fluid supplied to inlet fluid conduit 104 may be controlled by adjusting the relative quantities of the first and second fluids supplied thereto. In some embodiments, the first fluid disposed in first tank 118 comprises a brine kill fluid, while the second fluid disposed in second tank 122 comprises water, such as sea water. In some embodiments, surface system 102 includes a mud separator for separating the first and second fluids received from return fluid conduit 106, such that the first and second fluids may be separately supplied to first tank 118 and second tank 122, respectively.

Drill string 200 has a central or longitudinal axis 201 and is configured to provide a conduit for the circulation of drilling fluids between the surface system 102 and the wellbore 4. In the embodiment shown in FIG. 1, drill string 200 comprises a concentric drill string or pipe configured to convey fluids to and from wellbore 4 without a marine riser.

Particularly, drill string 200 generally comprises an inner tubular member or string 202 configured to provide for the recirculation of fluids from wellbore 4 to the return conduit 106 of surface system 102 along a recirculation flowpath 203 of inner string 202 in FIG. 1. Additionally, drill string 200 comprises an outer tubular member or string 204 disposed concentrically about inner string 202 configured to provide for the injection of drilling fluids into wellbore 4 from inlet fluid conduit 104 along a generally annular inlet or pumping flowpath 205 extending through an annulus formed between inner string 202 and outer string 204. As will be discussed further herein, drill string 200 is configured to provide a concentric drill string while allowing for the employment of standard or conventional drill pipe joints used in conjunction with one or more flow subs each receiving an inner tubular member for providing the inner string 202 of drill string 200. As will be discussed further herein, in some embodiments, the joints formed between each tubular member of inner string 202 are sealed via a premium type or gastight seal to provide a gastight seal between flowpaths 203 and 205. In addition, in some embodiments, the joints formed between each tubular member of outer string 204 are sealed via a premium type or gastight seal to provide a gastight seal between inlet flowpath 205 and the surrounding environment.

In the embodiment shown in FIG. 1, a first or upper end 200A of drill string 200 is coupled to a top drive assembly 130 and a lubrication assembly 132 above the rig floor 10 of the platform of drilling system 100. Top drive 130 is configured to apply a torque to drill string 200 at upper end 200A to rotate drill string 200 as string 200 is displaced axially through the wellbore 4. Lubrication assembly 132 is configured to lubricate components of drill string 200 as top drive 130 applies a torque to drill string 200. In the embodiment shown in FIG. 1, a second or lower end 200B of drill string 200 couples with a bottom hole assembly (BHA) 140 disposed in the wellbore 140 that includes a downhole motor 142 for rotating a drill bit 146 that engages the subterranean formation 6. Additionally, a check valve 144 is disposed between the motor 142 and drill bit 146 to prevent fluid within wellbore 4 from flowing into BHA 140 via ports (not shown) disposed in drill bit 146. In some embodiments, check valve 144 comprises a flapper type drilling float as is known in the art; however, check valve 144 may comprise other mechanisms configured to prevent backflow into BHA 140 from wellbore 4. Although in the embodiment shown in FIG. 1 drill string 200 is used with BHA 140, motor 142, check valve 144, and drill bit 146, in other embodiments, drill string 200 may be used in a variety of well system applications.

In the embodiment shown in FIG. 1, wellhead system 150 generally includes a wellhead 152, a wellhead connector 154 and a well containment or shut-in device (SID) 156. Wellhead 152 of wellhead system 150 provides structural support to the other components of wellhead system 150 including SID 156 while connector 154 provides a connection between wellhead 152 and SID 156. In the embodiment shown in FIG. 1, SID 156 includes a plurality of rams 158 configured to actuate or project into an annulus 12 formed radially between an outer surface of drill string 200 and an inner surface of an inner surface or wall of wellbore 4. In some embodiments, one or more of rams 158 comprise shear rams configured to shear drill string 200 to thereby restrict fluid communication between wellbore 4 and the surrounding environment (e.g., the sea) upon actuation; however, in other embodiments, rams 158 may comprise various rams or other actuatable sealing members known in the art.

Additionally, in the embodiment shown in FIG. 1, SID 156 includes an annular BOP 160 (shown in a closed position in FIG. 1) configured to seal against an outer surface of drill string 200 such that drilling and well fluids may be recirculated between the wellbore 4 and the surface system 102 via drill string 200 while fluid communication between the annulus 12 of wellbore 4 and the surrounding environment (e.g., the surrounding sea) is restricted. In other embodiments, annular BOP 160 may comprise a rotating control device (RCD) or other mechanism known in the art for sealing an annulus of a wellbore from a surrounding environment. Although not shown in FIG. 1, additional hydraulic lines may be connected to SID 156, such as choke or kill lines, for communicating pressurized fluid to the annulus 12.

Figure 2:
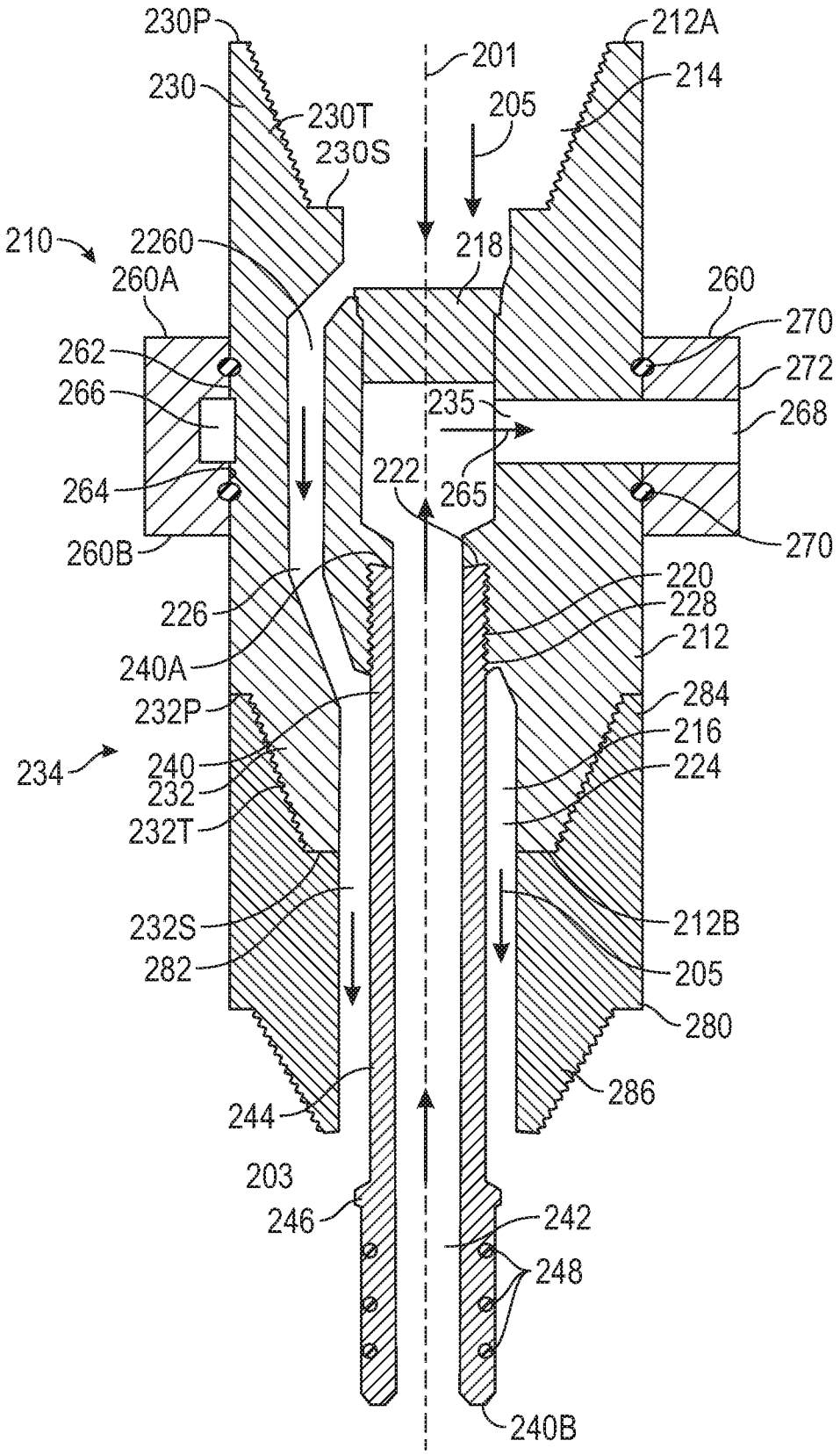
FIG. 2 is a side cross-sectional view of an embodiment of a circulation head of the well system of FIG. 1 in accordance with principles disclosed herein.
Figure 3:
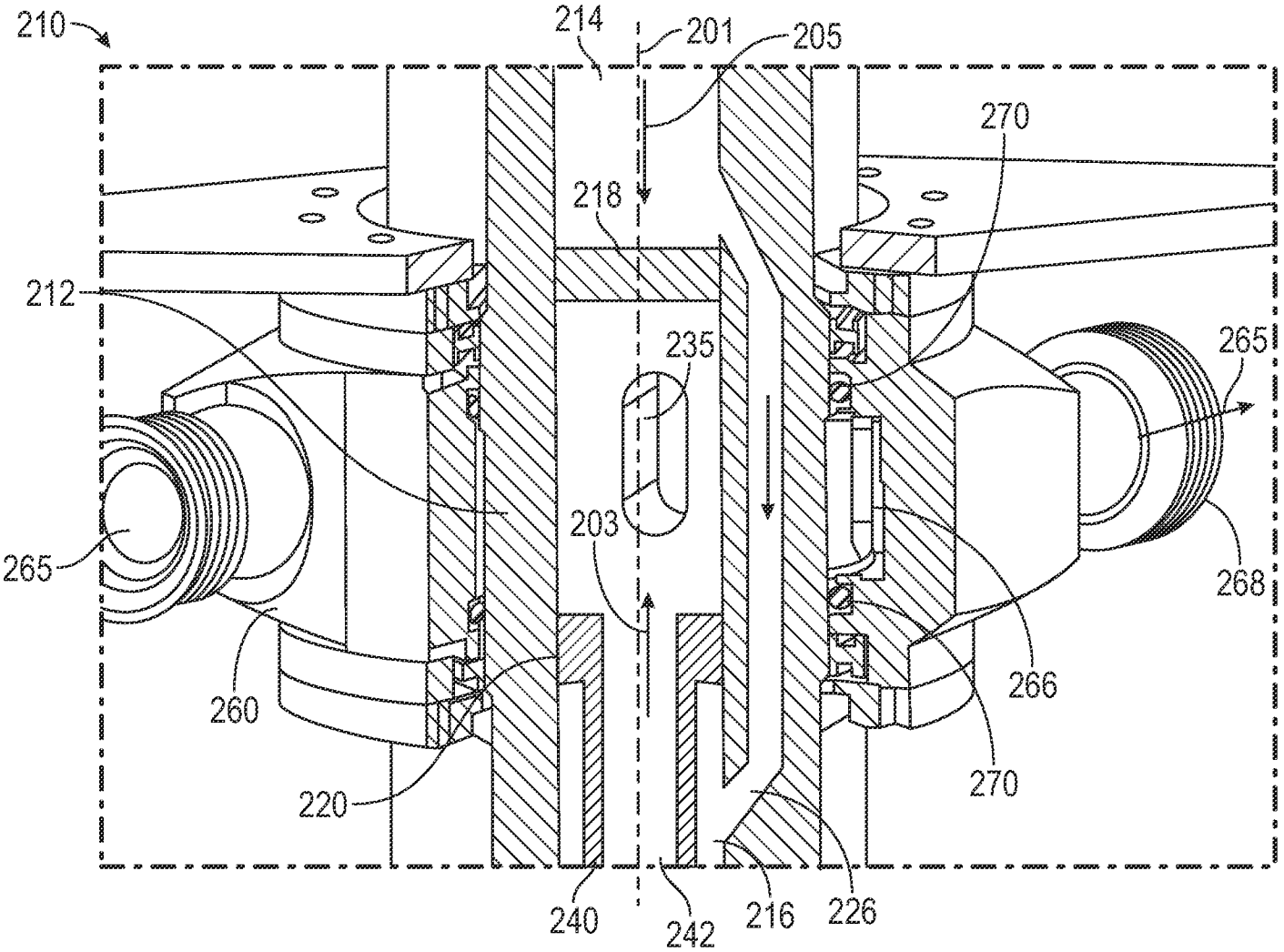
FIG. 3 is a perspective cross-sectional view of the circulation head of FIG. 2.

Referring to FIGS. 1-3, selective fluid communication between inlet conduit 104 of surface system 102 and the inlet flowpath 205 extending through drill string 200 is provided by an inlet valve 134 while selective fluid communication between return conduit 106 of surface system 102 and the recirculation flowpath 203 extending through string 200 is provided by a return valve 136. Particularly, in the embodiment shown in FIGS. 1-3, drill string 200 comprises a circulation head or swivel 210 at the upper end 200A thereof for providing an interface between conduits 104 and 106 of surface system 102 and flowpaths 205 and 203 of drill string 200, respectively. Additionally, circulation head 210 of drill string 200 is configured to allow for rotation of drill string 200 relative to conduits 104 and 106 of surface system 102 while simultaneously permitting fluid communication therebetween.

In the embodiment shown in FIGS. 2 and 3, circulation head 210 shares the central axis 201 of drill string 200 and generally includes a circulation housing or body 212, an inner tubular member 240, and a rotational member or swivel 260. Circulation body 212 has a first or upper end 212A, a second or lower end 212B, a central first or upper bore or passage 214 extending partially into body 212 from upper end 212A, and a central second or lower bore or passage 216 extending partially into body 212 from lower end 212B. Upper passage 214 receives fluid flow from inlet conduit 104 (selective isolation therebetween provided by inlet valve 134) while lower passage 216 provides fluid flow to return conduit 106 (selective isolation therebetween provided by return valve 136).

In this embodiment, circulation body 212 includes a centrally disposed plug or terminating member 218 disposed axially between passages 214 and 216 and restricting fluid flow directly between passages 214 and 216. Additionally, lower passage 216 includes a centrally disposed receptacle 220 formed on an inner surface thereof for receiving the inner tubular member 240. In the embodiment shown in FIGS. 1-3, receptacle 220 includes an annular shoulder 222 in engagement with or disposed directly adjacent inner tubular member 240. In some embodiments, the inner surface of receptacle 220 is threaded so as to threadably engage corresponding threads of inner tubular member 240; however, in other embodiments, receptacle 220 may comprise other mechanisms for releasably coupling with inner tubular member 240, such as via a lock ring or other member. In this arrangement, inner tubular member 240 extends through at least a portion of lower passage 216, forming an annulus 224 between an inner surface defining lower passage 216 and inner tubular member 240, where annulus 224 forms a portion of inlet flowpath 205 discussed above. Further, circulation body 212 includes one or more circumferentially spaced (if multiple) radial ports 235 that extend between an inner surface of lower passage 216 and an outer surface of body 212.

In the embodiment shown in FIGS. 1-3, circulation body 212 includes one or more bypass passages 226 extending between upper passage 214 and lower passage 216, thereby providing fluid communication therebetween. In some embodiments, body 212 includes a plurality of circumferentially spaced bypass passages 226, while in other embodiments, body 212 may only include a single bypass passage 226. In this embodiment, at least a portion (shown as 2260 in FIGS. 2 and 3) of bypass passage 226 is offset from central axis 201, allowing passage 226 to extend around plug 218 to connect between passages 214 and 216. Particularly, bypass passage 226 provides fluid communication between upper passage 214 and the annulus 224 formed in lower passage 216. In this arrangement, fluid communication between inlet flowpath 205 and recirculation flowpath 203 is restricted via an annular seal 228 formed between receptacle 220 of circulation body 212 and inner tubular member 240. In some embodiments, seal 228 comprises one or more O-ring or other annular elastomeric seals known in the art and positioned radially between receptacle 220 and inner tubular member 240. However, in the embodiment of FIGS. 1-3, seal 228 comprises a metal-to-metal gastight seal 228 formed at an annular interface between receptacle 220 and inner tubular member 240.

In the embodiment shown in FIGS. 1-3, circulation body 212 includes a first or upper connector 230 disposed at upper end 212A and a second or lower connector 232 disposed at lower end 212B. Upper connector 230 comprises a female or box connector including an outer or primary shoulder 230P, an inner or secondary shoulder 230S, and a threaded inner surface 230T extending between shoulders 230P and 230S. Conversely, lower connector 232 comprises a male or pin connector including an outer or primary shoulder 232P, an inner or secondary shoulder 232S, and a threaded outer surface 232T extending between shoulders 232P and 232S. Thus, in the embodiment shown in FIGS. 1-3, connectors 230 and 232 comprise rotary shouldered threaded connectors configured to releasably or threadably connect with corresponding rotary shouldered threaded connectors of other components of drill string 200.

Particularly, in this embodiment, connectors 230 and 232 comprise double or dual shouldered threaded connectors that utilize both primary (i.e., shoulders 230P and 232P) and secondary (i.e., shoulders 230S and 232S) shoulders for forming threaded connections with other components of drill string 200. However, in other embodiments, connectors 230 and 232 may comprise single-shouldered threaded connectors, or other releasable connectors known in the art other than threaded connectors. In some embodiments, at least one of the primary or secondary shoulders of connectors 230 and 232 of circulation body 212 is configured to provide a premium type connection affecting a gastight seal when engaged by the corresponding shoulder of an adjacent component of drill string 200 made-up or coupled therewith, thereby forming a gastight seal between inlet flowpath 205 and the surrounding environment.

Additionally, in the embodiment shown in FIGS. 1-3, connectors 230 and 232 are each axially offset or spaced from the bypass passage 226 extending between upper passage 214 and lower passage 216 of circulation bod 212. In this configuration, the radial width or thickness of each connector 230 and 232 does not need to be reduced, and passages need not extend therethrough, to allow for fluid communication between passages 214 and 216. In other words, connectors 230 and 232 may comprise standard or conventional high torque threaded connectors that are not diminished in strength (i.e., the amount of torque applied thereto during make-up need not be reduced) by the presence of bypass passage 226.

Moreover, given that standard threaded connectors may be used with circulation body 212, circulation body 212 may be coupled or made-up with conventional drill pipe joints, such as the conventional drill pipe joint 280 of drill string 200 shown schematically in FIG. 2. Particularly, drill pipe joint 280 includes a central bore or passage 282, first or upper box connector 284 and a second or lower pin connector 286, where box connector 284 is configured to threadably couple with the pin connector 232 of circulation body 212 to form a standard or conventional rotary shouldered threaded connection (RSTC) 234 therebetween, where RSTC 234 is unaffected by the presence (i.e., is not reduced in thickness and does not include any additional passages) of bypass passage 226 in circulation body 212. Additionally, in the embodiment shown in FIGS. 1-3, the upper connector 230 of circulation body 212 is configured to releasably couple with top drive assembly 130 (or an intermediate component positioned between assembly 130 and circulation head 210) such that top drive assembly 130 may apply torque to upper connector 230 and circulation body 210 to thereby rotate circulation body 210 and other components of drill string 200.

The inner tubular member 240 of circulation head 210 is generally configured to provide at least a portion of the recirculation flowpath 203 of drill string 200. In the embodiment shown in FIGS. 1-3, inner tubular member 240 has a first or upper end 240A, a second or lower end 240B, a central bore or passage 242 extending between ends 240A and 240B, and a generally cylindrical outer surface 244 also extending between ends 240A and 240B. Recirculation flowpath 203 of drill string 200 extends through passage 242 of inner tubular member 240. In this embodiment, the upper end 240A of inner tubular member 240 is received in the receptacle 220 of circulation body 212. In some embodiments, a portion of the outer surface 244 extending from upper end 240A is threaded for threadably connecting with receptacle 220. In the embodiment shown in FIGS. 1-3, the outer surface 244 of inner tubular member 240 includes an annular and radially outwards extending shoulder or landing profile 246 proximal lower end 240B for physically engaging a corresponding shoulder or landing profile disposed within another component of drill string 200.

Additionally, the outer surface 244 of inner tubular member 240 includes an annular seal assembly 248 disposed therein proximal lower end 240B. Seal assembly 248 is configured to sealingly engage an annular receptacle of another component of drill string 200 to thereby seal recirculation flowpath 203 from inlet flowpath 205. In the embodiment shown in FIGS. 1-3, seal assembly 248 comprises a plurality of axially spaced elastomeric seals disposed in outer surface 244; however, in other embodiments, seal assembly 248 may comprise an annular seal interface for forming a metal-to-metal gastight seal with a corresponding annular seal interface of another component of drill string 200. Further, in some embodiments, at least a portion of the outer surface 244 of inner tubular member 240 extending between landing profile 246 and lower end 240B may be threaded for threadably connecting with a corresponding threaded receptacle of another component of drill string 200. In still other embodiments, other releasable coupling mechanisms, such as lock rings and the like, may be positioned between the portion of outer surface 244 proximal lower end 240B for releasably coupling inner tubular member 240 with another component of drill string 240.

Swivel 260 of circulation head 210 is generally configured to provide for fluid communication between recirculation flowpath 206 (extending through passage 242 of inner tubular member 240 and at least a portion of lower passage 216 of circulation body 212) of drill string 200 and the return conduit 106 of surface system 102 while drill string 200 rotates (e.g., from a torque applied by top drive assembly 130) relative components of surface system 102, including return conduit 106. In the embodiment shown in FIGS. 1-3, swivel 260 is generally annular in shape and includes a first or upper end 260A, a second or lower end 260B, and a central bore or passage 262 extending between ends 260A and 260B and defined by a generally cylindrical inner surface 264.

The inner surface 264 of swivel 260 includes an annular channel or groove 266 disposed therein that is in fluid communication with one or more radial ports or passages 268 that are in fluid communication with return conduit 106. In this arrangement, a radial flowpath 265 is formed that extends between lower passage 216 of circulation body 212, through radial port 235, into channel 266 of swivel 260, and from channel 266 into return conduit 106 via radial port 268. Further, given that channel 266 extends the entire circumference of swivel 260, fluid communication is provided between the radial port 235 of circulation body 212 and the radial port 268 of swivel 260 irrespective of the relative angular position of circulation body 212 and swivel 260.

In the embodiment shown in FIGS. 1-3, swivel 260 includes an annular seal assembly 270 positioned radially between the inner surface 264 of swivel 260 and the outer surface of circulation body 212 and flanking each axial end of channel 266, thereby restricting fluid communication between channel 266 and the surrounding environment. Additionally, seal assembly 270 is configured to seal between swivel 260 and circulation body 212 while circulation body 212 (and inner tubular member 240 coupled thereto) rotates relative swivel 260, which remains stationary respective surface system 102. In this embodiment, seal assembly 270 comprises a plurality of axially spaced annular seals 270; however, in other embodiments, seal assembly 270 may comprise other sealing mechanisms known in the art. Further, the inner surface 264 of swivel 260 comprises a bearing 272 positioned radially between inner surface 264 and the outer surface of circulation body 212 to permit relative rotation between body 212 and swivel 260. In some embodiments, bearing 272 may comprise a lubricated interface between inner surface 264 and the outer surface of circulation body 212, while in other embodiments, bearing 272 may comprise other bearings known in the art, including ball or needle bearings and the like.

Figure 4:
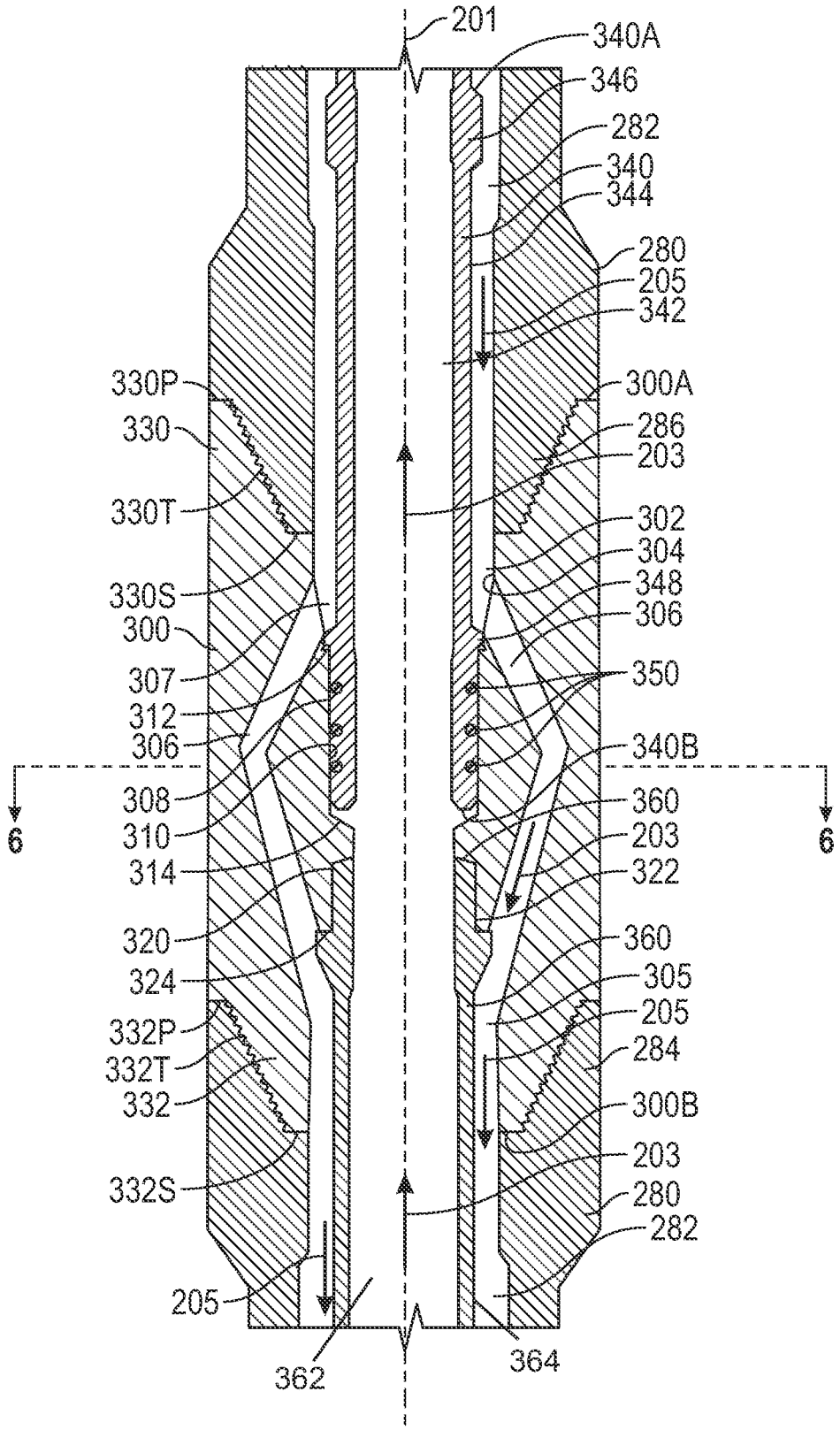
FIG. 4 is a side cross-sectional view of an embodiment of a flow sub of the well system of FIG. 1 in accordance with principles disclosed herein.
Figure 5:
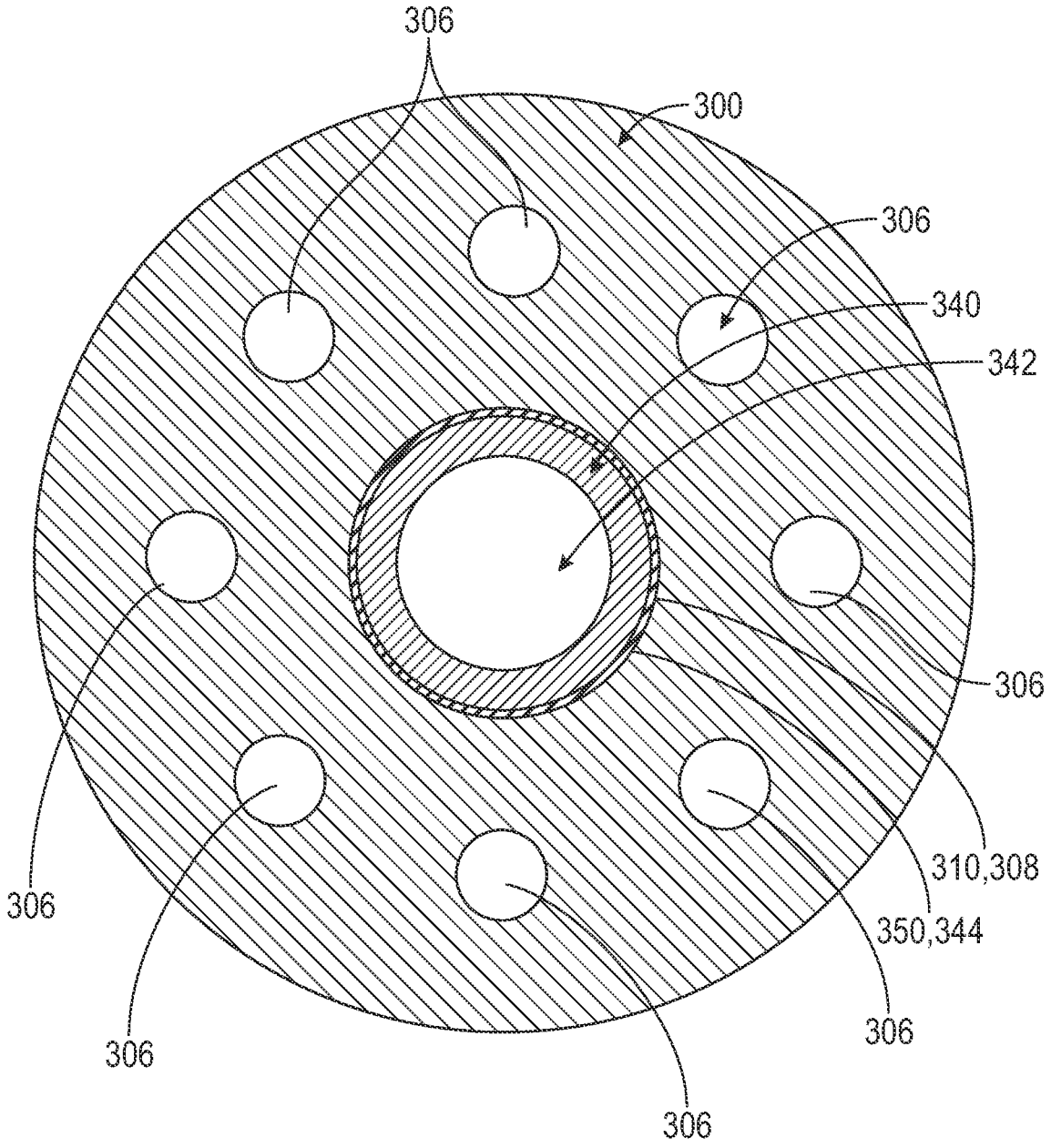
FIG. 5 is a cross-sectional view along line 6-6 of FIG. 4 of the flow sub of FIG. 4.

Referring to FIGS. 1, 4, and 5, an embodiment of a flow sub 300 coupled to a pair of adjacent drill pipe joints 280 is shown in FIGS. 4 and 5. Flow sub 300 is generally configured to provide CDP functionality (e.g., pumping into and recirculation from a wellbore without using a riser, etc.) while using conventional drill pipe joints and without sacrificing or diminishing the strength or torque capacity of the releasable connections formed between the components of drill string 200. Additionally, flow subs 300 are configured to provide CDP functionality while also providing the flexibility of coupling or making up stands of drill pipe (i.e., multiple connected pipe joints 280) at a time when running into a wellbore and decoupling stands of drill pipe at a time when running out of a wellbore, depending on the application.

In the embodiment shown in FIGS. 1-3, flow sub 300 shares central axis 201 with drill string 200 and includes a first or upper end 300A, a second or lower end 300B, and a central bore or passage 302 extending between ends 300A and 300B and defined by a generally cylindrical surface 304. Additionally, flow sub 300 includes a plurality of circumferentially spaced bypass passages 306 extending between a portion of passage 302 proximal upper end 300A and a portion of passage 302 proximal lower end 300B. Flow sub 300 further includes a first or upper receptacle 308 configured to receive a first or upper inner tubular member 340 and a second or lower receptacle 320 configured to receive a second or lower inner tubular member 360. Receptacles 308 and 320 of flow sub 300 provide functionality similar to that of the receptacle 220 of circulation head 210 discussed above. Bypass passages 306 each include at least a portion that is radially offset from central axis 201 and are configured to allow fluid flow disposed in an annulus 307 of flow sub 300 formed between inner surface 304 of flow sub 300 and inner tubular members extending therein to flow around receptacles 308 and 320, thereby forming a portion of inlet flowpath 205.

In the embodiment shown in FIGS. 1, 4, and 5, upper receptacle 308 of flow sub 300 includes a generally cylindrical inner sealing surface 310, an upwardly facing (i.e., facing upper end 300A of flow sub 300) annular landing shoulder or profile 312, and an inner or recessed shoulder 314 axially spaced from landing shoulder 312. Lower receptacle 320 of flow sub 300 includes a generally cylindrical inner engagement surface 322, and an annular engagement shoulder 324. In this embodiment, at least a portion of each surface 310 and 322 of receptacles 308 and 320, respectively, are smooth to provide for sealing engagement with a corresponding seal interface or assembly off the inner tubular member received therein.

In the embodiment shown in FIGS. 1, 4, and 5, flow sub 300 includes a first or upper connector 330 disposed at upper end 300A and a second or lower connector 332 disposed at lower end 300B. Upper connector 330 comprises a female or box connector including an outer or primary shoulder 330P, an inner or secondary shoulder 330S, and a threaded inner surface 330T extending between shoulders 330P and 330S. Conversely, lower connector 332 of flow sub 300 comprises a male or pin connector including an outer or primary shoulder 332P, an inner or secondary shoulder 332S, and a threaded outer surface 332T extending between shoulders 332P and 332S. Thus, in this embodiment, connectors 330 and 332 of flow sub 300 comprise rotary shouldered threaded connectors configured to releasably or threadably connect with corresponding rotary shouldered threaded connectors of other components of drill string 200, similar to connectors 230 and 232 of circulation head 210 described above. Also similar to the configuration of circulation head 210, connectors 330 and 332 of flow sub 300 are axially offset or spaced from bypass passages 306, thereby allowing for bypass flow while not weakening or reducing the amount of torque that may be applied to connectors 330 and 332. Further, connectors 330 and 332 are configured to releasably couple with standard rotary shouldered threaded connectors known in the art, such as the connectors 284 and 286 of conventional drill pipe joints 280, as shown particularly in FIG. 4.

Inner tubular members 340 and 360 are similar in functionality and configuration as inner tubular member 240 of the circulation head 210 discussed above. In the embodiment shown in FIGS. 1, 4, and 5, inner tubular member 340 includes a central bore or passage 342 and a generally cylindrical outer surface 344 while inner tubular member 360 similarly includes a central bore or passage 362 and a generally cylindrical outer surface 364. Additionally, the upper inner tubular member 340 has a first or upper end 340A including a gastight connector 346 for forming a gastight connection with an adjacently connected inner tubular member coupled therewith. In this manner, multiple inner tubular members (e.g., inner tubular members 240, 340, 360, etc.) may be coupled together for forming strings of coupled inner tubular members, where only the upper and lower inner tubular members of the inner tubular member string engage a flow sub or other component of drill string 200.

In the embodiment shown in FIGS. 1, 4, and 5, the outer surface 342 of inner tubular member 340 includes an annular and radially outwards extending shoulder or landing profile 348 proximal a lower end 340B of member 340 for physically the landing shoulder 312 of upper receptacle 308. Additionally, the outer surface 344 of inner tubular member 340 includes an annular seal assembly 350 disposed therein proximal lower end 340B. Seal assembly 350 is configured to sealingly engage the inner sealing surface 310 of upper receptacle 308 to thereby seal recirculation flowpath 203 from inlet flowpath 205. In the embodiment shown in FIGS. 1, 4, and 5, seal assembly 350 comprises a plurality of axially spaced elastomeric seals disposed in outer surface 344; however, in other embodiments, seal assembly 350 may comprise an annular seal interface for forming a metal-to-metal gastight seal with inner sealing surface 310 of upper receptacle 308. Further, in some embodiments, a portion of the outer surface 344 of inner tubular member 340 may be threadably or otherwise releasably coupled to the inner sealing surface 310 of upper receptacle 308. In some embodiments, the lower end 340B of inner tubular member 340 is axially spaced from recessed shoulder 314 of upper receptacle 308 to accommodate changes in length of the drill pipe joints 280 forming drill string 200 during the operation of string 200. In this embodiment, the outer surface 364 of lower inner tubular member 360 is releasably coupled and sealingly engages (gastight, elastomeric, gastight, etc.) the inner engagement surface 322 of lower receptacle 320 such that inner tubular member 360 is suspended from lower receptacle 320 and flow sub 300.

In the arrangement described above, passages 342 and 362 of inner tubular members 340 and 360, respectively, form a portion of recirculation flowpath 203 while inlet flowpath 205 passes through the annulus formed between inner tubular members 340, 360, and the flow sub 300 and coupled pipe joints 280. In this arrangement, drill string 200 generally comprises lengths of multiple drill pipe joints 280 coupled together with flow subs 300 coupled between predetermined pipe joints 280, where one or more inner tubular members (e.g., inner tubular members 240, 340, 360, etc.) extending between corresponding pairs of flow subs 300. For instance, in an embodiment, a flow sub 300 may be coupled between each pair of pipe joints 280, with a single inner tubular member extending between corresponding pairs of flow subs 300. In another embodiment, a flow sub 300 may be coupled between a stand of drill pipe joints comprising, for instance, three pipe joints 280 coupled in sequence, with a plurality of coupled inner tubular members extending between corresponding pairs of flow subs 300 (i.e., an inner tubular string extends through each stand of, for instance, three sequentially coupled pipe joints 280). In this arrangement, circulation body 212 of circulation head 210, drill pipe joints 280, and flow subs 300 comprise the outer string 204 of drill string 200 while inner tubular members (e.g., inner tubular members 240, 340, 360, etc.) comprise the inner string 202 of drill string 200.

In some embodiments, when flow subs 300 are coupled between stands of multiple pipe joints 280, an individual stand of pipe joints 280 (including at least one flow sub 300 coupled thereto) may be coupled to the upper end of the drill string 200 with a lower end of the inner tubular member of the flow sub 300 of the particular stand of pipe joints 280 being stabbed into the upper receptacle 308 of the uppermost flow sub 300 of the previously assembled drill string 200. In turn, the lowermost pipe joint 280 of the stand of pipe joints 280 may be threadably connected to the uppermost flow sub 300 of the drill string 200 to thereby couple the particular stand of pipe joints 280 (and associated flow sub 300, which is coupled to the uppermost pipe joint 280 of the stand of pipe joints 280) to the drill string 200.

In some embodiments, the individual stand of drill pipe joints 280, along with its associated flow sub 300, may be similarly removed from the drill string 200 when the string 200 is being run out of the wellbore. Thus, flow subs 300 provide additional flexibility (e.g., can pull a single pipe joint 280 or a stand of multiple joints 280 from string 200 depending on the arrangement of flow subs 300, etc.) when running into or out of the wellbore with the drill string 200. Further, since the lower terminal end of the inner tubular member or string being added to the drill string 200 (when running string 200 into the wellbore) need not be threadably connected to the uppermost flow sub 200 of the assembled drill string 200, the lower terminal end of the inner tubular member or string may only be stabbed into the upper receptacle 308 of the uppermost flow sub 300 of the assembled drill string 200 to thereby form an additional length of sealed recirculation flowpath 203 (and corresponding sealed inlet flowpath 205) to drill string 200.

Figure 6:
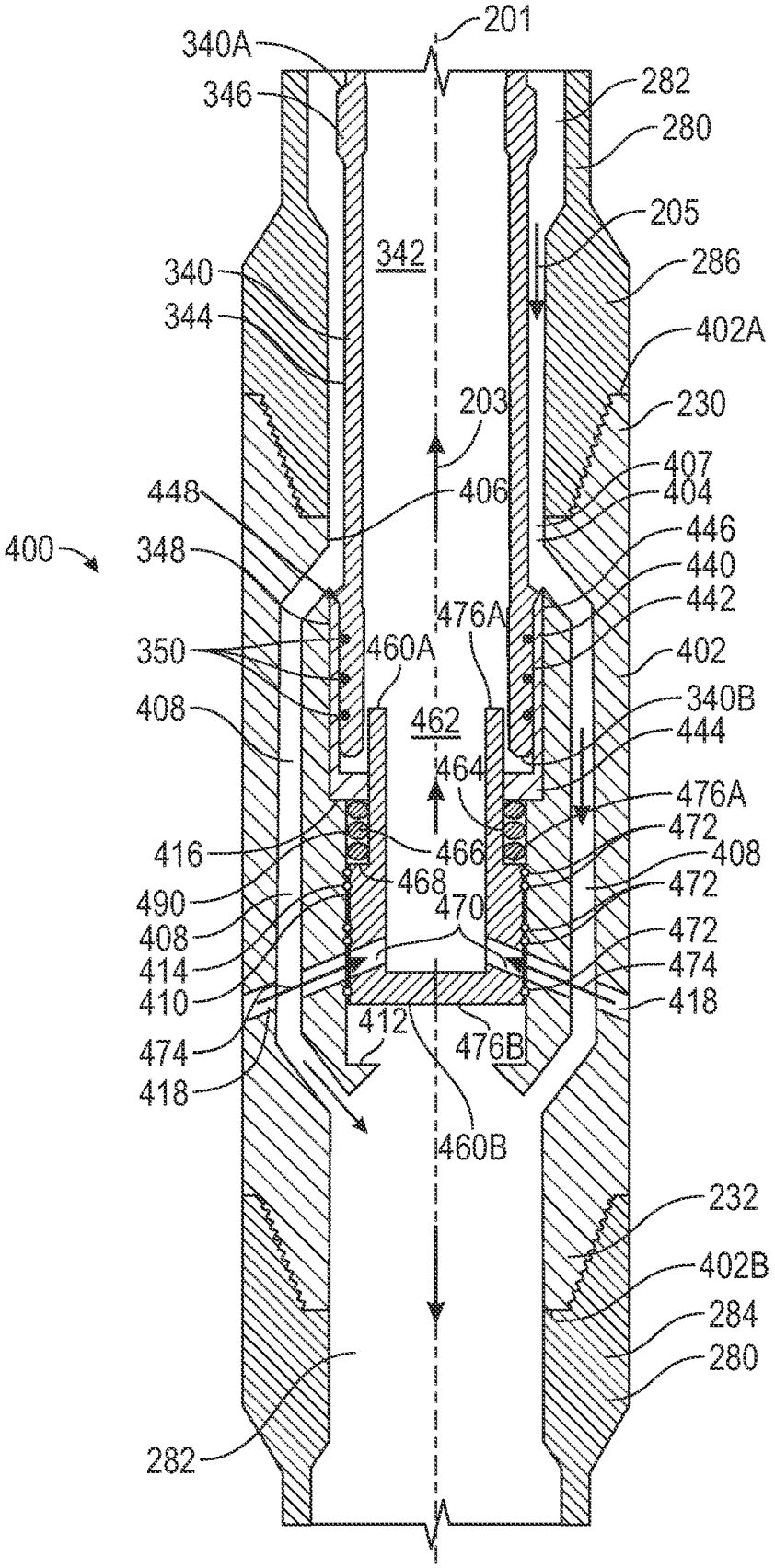
FIG. 6 is a side cross-sectional view of an embodiment of a concentric valve of the well system of FIG. 1 shown in a first position in accordance with principles disclosed herein.
Figure 7:
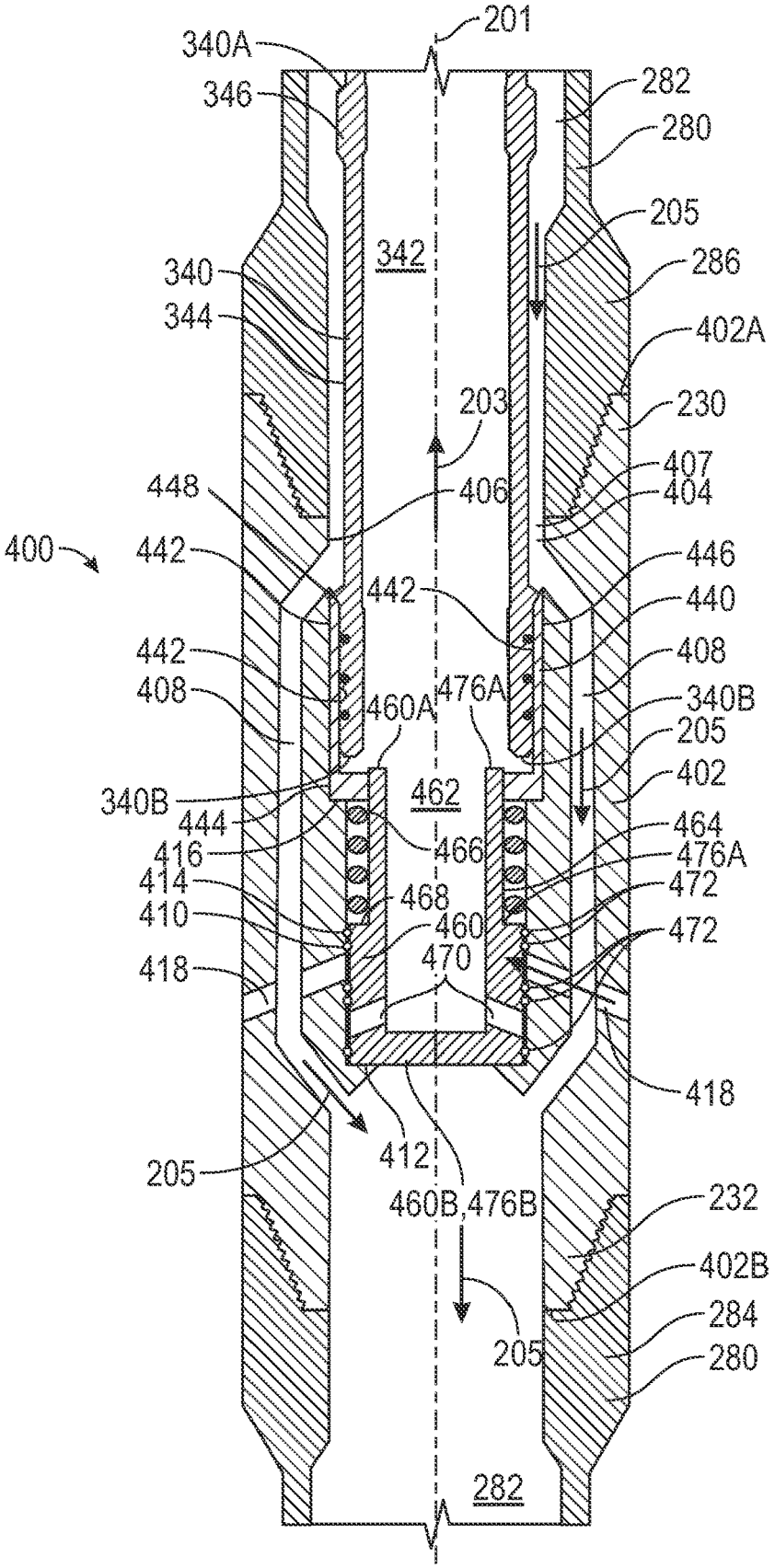
FIG. 7 is a side cross-sectional view of the concentric valve of FIG. 6 shown in a second position.

Referring to FIGS. 1, 6, and 7, an embodiment of a tubular concentric valve 400 of the drill string 200 of FIG. 1 is shown. As shown particularly in FIG. 1, concentric valve 400 is disposed at the lower end 200B of drill string 200 and is generally configured to provide selective fluid communication between recirculation flowpath 203 extending through drill string 200 and the annulus 12. Additionally, concentric valve 400 is configured to provide fluid communication or crossover between an annular portion of inlet flowpath 205 and a portion of inlet flowpath 205 that extends through a central passage of drill string 200 (e.g., passage 282 of one or more drill pipe joints 280, etc.) extending between concentric valve 400 and the drill bit 146, where the fluid flowing through inlet flowpath 205 is injected into the wellbore 4. Further, in this embodiment, valve 400 is configured to allow for fluid flow between flowpath 203 and annulus 12 when fluid pressure in inlet flowpath 205 is greater than fluid pressure in recirculation flowpath 203, and to restrict fluid flow between flowpath 203 and annulus 12 when fluid pressure in inlet flowpath 205 is less than fluid pressure in recirculation flowpath 203, such as when fluid is not being pumped (e.g., from pumps 120 and/or 124) through inlet flowpath 205 (e.g., when one or more pipe joints 280 and a corresponding flow sub 300 are being releasably coupled or made-up with an upper end of drill string 200, etc.), thereby preventing a reversal of fluid flow through drill string 200.

Concentric valve 400 includes features in common with flow sub 300 shown in FIGS. 4 and 5, and shared features are labeled similarly. In the embodiment shown in FIGS. 1, 6, and 7, concentric valve 400 shares central axis 201 with drill string 200 and generally includes a valve body or housing 402, an insert sleeve 440, and a flow piston 460 slidably disposed in valve body 402. Valve body 402 has a first or upper end 402A, a second or lower end 402B, a central bore or passage 404 extending between ends 402A and 402B and defined by a generally cylindrical inner surface 406. Valve body 402 additionally includes a plurality of circumferentially spaced bypass passages 408 extending between a portion of passage 404 disposed proximal upper end 402A and a portion of passage 404 disposed proximal lower end 402B. Additionally, an annulus 407 is formed between the inner surface 406 of valve body 402 and an outer surface 344 of an inner tubular member 340 (suspended from a flow sub 300 disposed above concentric valve 400 and not shown in FIGS. 6 and 7) extending into the upper end 402A of valve body 402. In this manner, bypass passages 408 provide for fluid flow between annulus 407 and the portion of passage 404 disposed at lower end 402B.

In this embodiment, valve body 402 includes a centrally disposed receptacle 410 around which bypass passages 408 extend (at least a portion of each passage 408 being radially offset from central axis 201), thereby allowing fluid flowing along inlet flowpath 205 to bypass or flow around receptacle 410. Receptacle 410 includes an annular shoulder or seat 412 formed at a lower end thereof, and a reduced diameter section 414 of inner surface 406 of body 402 that forms an annular insert shoulder or seat 416. Insert sleeve 440 is generally cylindrical in shape and is received in the reduced diameter section 414 of receptacle 410. In the embodiment shown in FIGS. 1, 6, and 7, sleeve 440 includes a central bore defined by an inner sealing surface 442 and an annular, radially inwards extending flange 444 disposed at a lower end of sleeve 440. Insert sleeve 440 additionally includes an annular landing shoulder or profile 448 disposed at the upper end of sleeve 440 for engaging the landing shoulder 348 of inner tubular member 340, thereby allowing for the lower end 340B of tubular member 340 to be landed within insert sleeve 440 with seal assembly 350 of member 340 in sealing engagement with inner sealing surface 442 of sleeve 440. In some embodiments, an axial gap extends between the lower end 340B of inner tubular member 340 and flange 444 to permit changes in the axial length of drill string 200 relative inner tubular member 340 during operation of string 340.

In this embodiment, sleeve 440 is releasably coupled (e.g., threadably coupled, coupled via a locking member, etc.) to the inner surface 406 of an upper portion of receptacle 410 (i.e., portion disposed above reduced diameter section 414) where the lower end of sleeve 440 is disposed directly adjacent or physically engages insert shoulder 416 of receptacle 410. In other embodiments, sleeve 440 may be formed integrally with receptacle 410 and valve body 402 as a single, unitary component. Valve body 402 additionally includes a plurality of circumferentially spaced angled or radial ports 418 that extend between the portion of passage 404 extending through receptacle 410 and an outer cylindrical surface of valve body 402. Radial ports 418 are angularly or circumferentially spaced from bypass passages 408, and thus, fluid communication is restricted between ports 418 and passages 408.

Flow piston 460 of concentric valve 400 is generally cylindrical in shape and is configured to provide selective fluid communication between passage 404 of valve body 402 and the surrounding environment (i.e., annulus 12 shown in FIG. 1). In the embodiment shown in FIGS. 1, 6, and 7, flow piston 460 has a first or upper end 460A, a second or lower end 460B, a chamber 462 extending into piston 460 from upper end 460A, and a generally cylindrical outer surface 464 extending between ends 460A and 460B. The outer surface 464 of piston 460 includes a reduced diameter section 466 extending from upper end 460A that forms an annular shoulder 468. Reduced diameter section 466 of outer surface 464 is sized such that the upper portion of flow piston 460 defined by reduced diameter section 466 is permitted to pass through flange 444 of insert sleeve 440 while shoulder 468 is restricted from passing through flange 444.

In this embodiment, a biasing member 490 (e.g., a coiled spring, a plurality of disc springs, a compressible fluid disposed in a sealed chamber, etc.) is disposed about the reduced diameter section 466 and extend axially between annular shoulder 468 of piston 460 and the flange 444 of insert sleeve 440. In this arrangement, biasing member 490 is configured to apply an axial biasing force against flow piston 460 in the direction of seat 412 of valve body 402. In other words, when no net pressure force is applied to flow piston 460, biasing member 490 biases piston 460 towards seat 412 such that the lower end 460B of piston 460 is disposed directly adjacent or physically engages seat 412, a position of piston 460 shown in FIG. 7.

In the embodiment shown in FIGS. 1, 6, and 7, flow piston 460 of concentric valve 400 includes a plurality of circumferentially spaced angled or radial ports 470 disposed proximal lower end 460B, where radial ports 470 extend radially between outer surface 464 and chamber 462. Additionally, the outer surface 464 of piston 460 includes an annular seal assembly 472 configured to restrict fluid communication from both radial ports 470 of piston 460 and radial ports 418 of valve body 402 and the inlet flowpath 205 extending through annulus 407 and the portion of passage 404 of valve body 402 disposed at the lower end 402B of body 402. In this manner, inlet flowpath 205 crosses over from an annular flowpath above concentric valve 400 to a central flowpath extending below valve 400 that runs to the drill bit 146, where fluid flowing along inlet flowpath 205 is injected into wellbore 4 via ports disposed in bit 146. In the embodiment shown in FIGS. 1, 6, and 7, seal assembly 472 comprises a plurality of axially spaced elastomeric seals 472 that flank both radial ports 470 and radial ports 418 when piston 460 is both in the position shown in FIG. 6 and the position shown in FIG. 7; however, in other embodiments, seal assembly 472 may comprise other sealing mechanisms or interfaces known in the art.

In this embodiment, flow piston 460 of concentric valve 400 comprises a first or open position shown in FIG. 6 and a second or closed position shown in FIG. 7 that is axially spaced from the open position. Particularly, in the open position shown in FIG. 6, the lower end 460B of piston 460 is axially spaced from seat 412 with biasing member 490 in a compressed position (relative the open position of piston 460) and radial ports 470 of piston 460 axially aligned with radial ports 418 of valve body 402 to permit fluid communication therebetween, and thus, between annulus 12 and the chamber 462 of piston 460. In this arrangement, a radial fluid return flowpath 474 is established that flows from annulus 12 through radial ports 418, from ports 418 into ports 470, and from ports 470 into chamber 462 and the passage 342 of inner tubular member 340. In this manner, fluid flow from annulus 12 is provided to recirculation flowpath 203 via radial return flowpath 474. At the same time, seal assembly 472 restricts fluid communication between radial return flowpath 474 and inlet flowpath 205 of drill string 200.

In the closed position of flow piston 460 shown in FIG. 7, lower end 460B of piston 460 is disposed directly adjacent or physically engages seat 412 of valve body 402 while the radial ports 470 of piston 460 are axially misaligned with the radial ports 418 of body 402, restricting fluid communication between radial ports 418 and the chamber 462 of piston 460. In this position, fluid communication between annulus 12 and recirculation flowpath 203 is restricted via seal assembly 472 of piston 460. However, fluid flow is still permitted to travel between annulus 407 and the lower end of passage 404 along inlet flowpath 205.

Flow piston 460 is actuatable between the open and closed positions in response to differences in fluid pressure in the recirculation flowpath 203 and the inlet flowpath 205. Particularly, in the embodiment shown in FIGS. 1, 6, and 7, piston 460 comprises a first or upper annular piston area 476A that receives fluid pressure from recirculation flowpath 203 and a second or lower annular piston area 476B that receives fluid pressure from inlet flowpath 205. In this embodiment, upper piston area 476A generally includes the upper end 460A and shoulder 468 of piston 460 while the lower piston area 476B generally includes the lower end 460B of piston 460, where piston areas 476A and 476B are substantially similar in size. In this arrangement, when fluid pressure in recirculation flowpath 203 proximal valve 400 is equal to fluid pressure in inlet flowpath 205 proximal valve 400, no net pressure force is applied to piston 460 and biasing member 490 acts to hold piston 460 in the closed position shown in FIG. 7.

However, if fluid pressure in inlet flowpath 205 increases a to sufficient degree greater than fluid pressure in recirculation flowpath 203, an axially directed upwards net pressure force is applied to piston 460 sufficient to overcome the downwards biasing force provided by biasing member 490 to actuate piston 460 from the closed position shown in FIG. 7 to the open position shown in FIG. 6. In some embodiments, the sufficient net pressure force is applied to piston 460 when fluid is being actively pumped through inlet flowpath 205 via pumps 120 and/or 124. However, at times pumping into drill string 200 may be ceased, such as when drill pipe joints or stands are being added to drill string 200, at which point biasing member 490 actuates piston 460 into the closed position to prevent fluids in wellbore 4 from uncontrollably flowing upwards into drill string 200 through recirculation flowpath 203.

Figure 8:
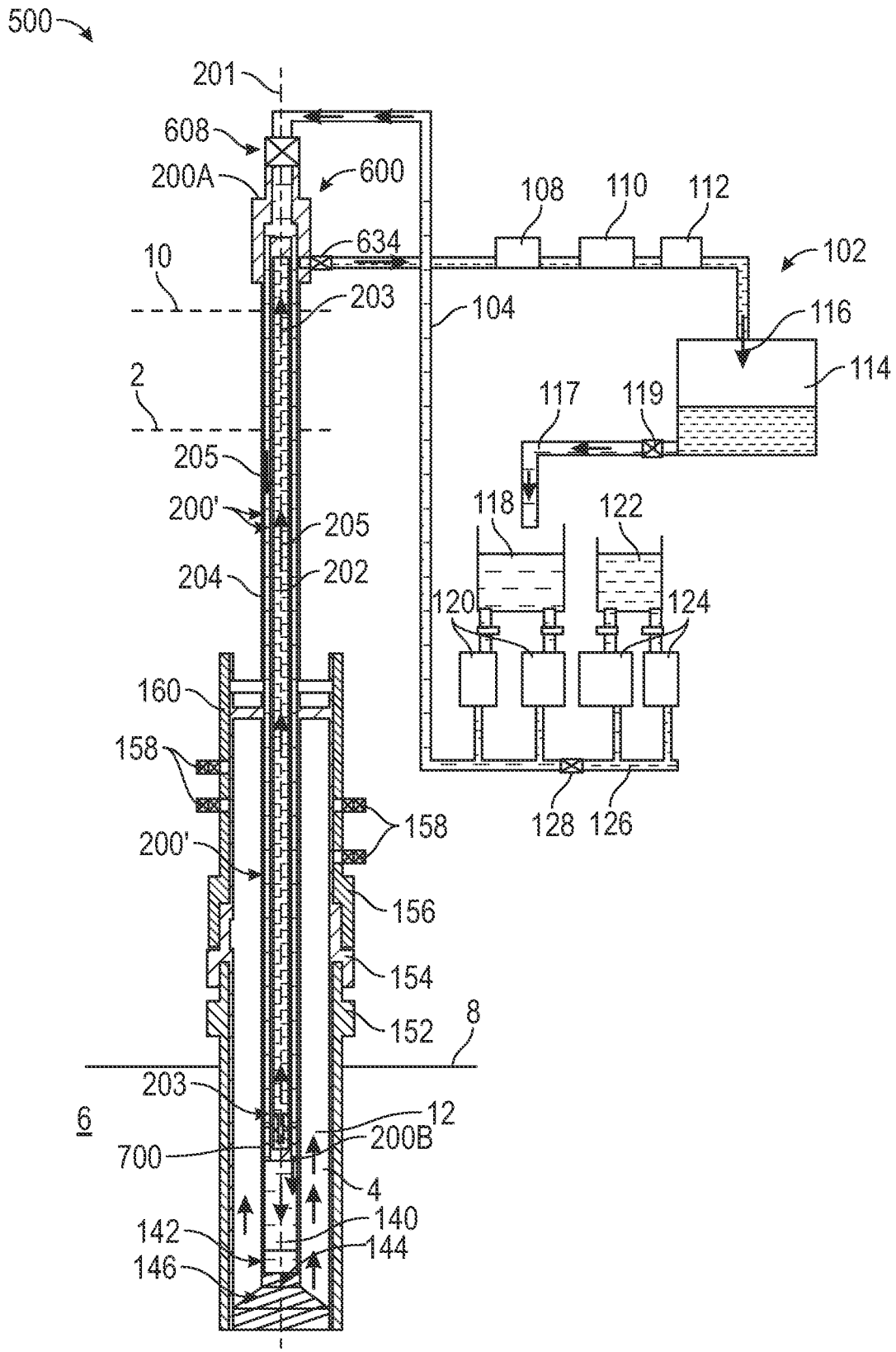
FIG. 8 is a schematic view of another embodiment of a well system in accordance with principles disclosed herein.

Referring to FIG. 8, another embodiment of a well or drilling system 500 is shown schematically. Drilling system 500 includes features in common with drilling system 100 shown in FIG. 1, and shared features are labeled similarly. Particularly, drilling system 500 is similar to drilling system 100 except that system 500 uses a drill string 200' in lieu of drill string 200, where drill string 200' includes a stab-in assembly 600 in lieu of the circulation head 210 of drill string 210, and a crossover sub 700 in lieu of the concentric valve 400 of drill string 200. In the embodiment of FIG. 8, stab-in assembly 600 is disposed at or near the rig floor 10 and is not coupled to a top drive assembly. Thus, drill string 200' of drilling system 500 is axially displaced into wellbore 4 without being at least partially rotated by a top drive assembly.

Figure 9:
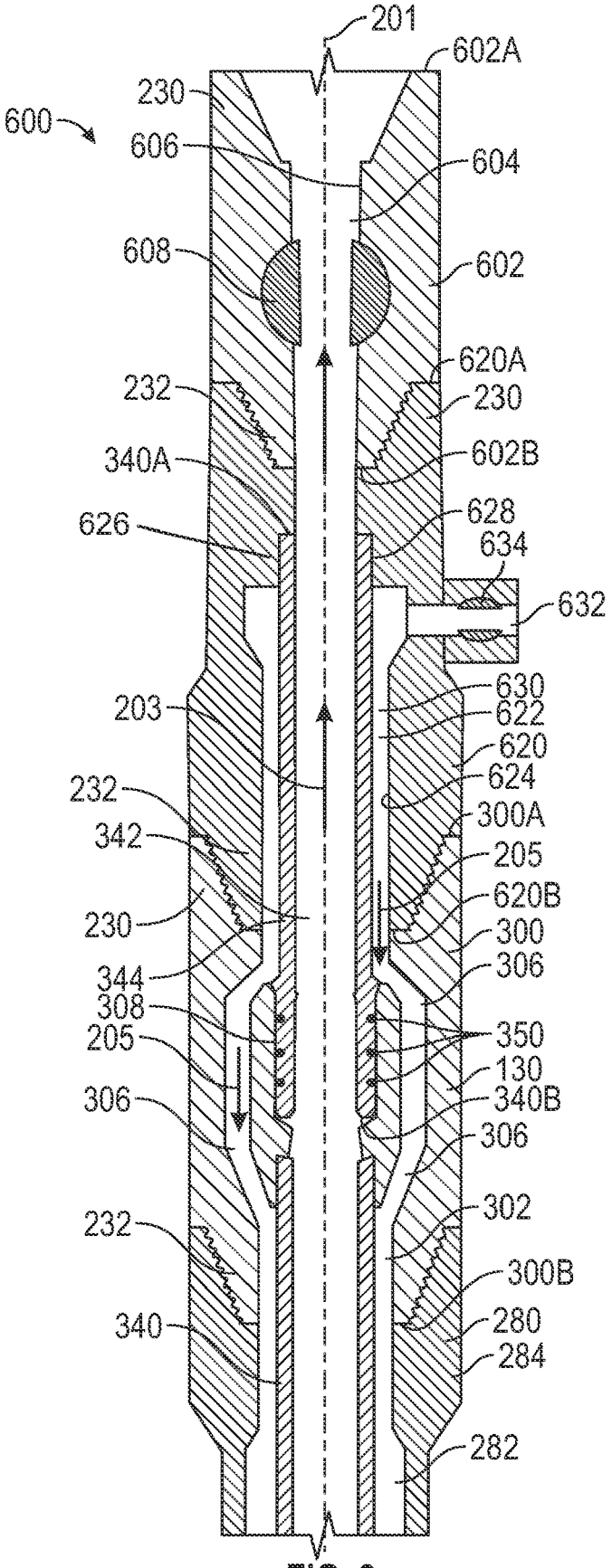
FIG. 9 is a side cross-sectional view of an embodiment of a stab-in assembly of the well system of FIG. 8 in accordance with principles disclosed herein.

Referring to FIGS. 8 and 9, an embodiment of a stab-in assembly 600 is shown in FIG. 9. Stab-in assembly 600 includes features in common with components of drill string 200 described above, and shared features are labeled similarly. Stab-in assembly 600 is configured to provide selective fluid communication between return conduit 106 and recirculation flowpath 203, and between the inlet conduit 104 and inlet flowpath 205. In the embodiment shown in FIG. 9, stab-in assembly 600 shares the central axis 201 with drill string 200' and generally includes a return sub 602 and an inlet sub 620.

Return sub 602 is generally configured to provide selective fluid communication between return conduit 106 of surface system 102 and recirculation flowpath 203 of drill string 200'. Return sub 602 has a first or upper end 602A, a second or lower end 602B, and a central bore or passage 604 extending between ends 602A and 602B and defined by a generally cylindrical inner surface 606. Passage 604 of return sub 602 forms a portion of recirculation conduit 203 an includes a concentric valve 608 disposed therein for selectively restricting fluid flow through passage 604. In the embodiment shown in FIG. 9, concentric valve 608 comprises a concentric ball valve; however, in other embodiments, concentric valve 608 may comprise other types of valves known in the art. In this arrangement, concentric valve 608 may be used to selectively isolate recirculation flowpath 203 from the return conduit 106 of surface system 102.

The inlet sub 620 of stab-in assembly is generally configured to provide selective fluid communication between the inlet conduit 104 of surface system 102 and the inlet flowpath 205 of drill string 200'. In the embodiment shown in FIGS. 8 and 9, inlet sub 620 has a first or upper end 620A, a second or lower end 620B, and a bore or passage 622 extending between ends 620A and 620B and defined by a generally cylindrical inner surface 624. Additionally, inlet sub 620 includes a receptacle 626 for receiving and coupling with the upper end 240A of an inner tubular member 240 via an annular engagement surface 628. Engagement surface 628 is configured to sealingly engage the outer surface 244 of inner tubular member 240, including, in some embodiments, forming a gastight seal with outer surface 244. In some embodiments, a seal assembly, such as one or more annular elastomeric seals, are disposed radially between engagement surface 628 of inlet sub 620 and the outer surface 244 of inner tubular member 240, while in other embodiments, surfaces 628 and 244 are configured to provide a metal-to-metal seal therebetween.

In the arrangement shown in FIG. 9, inner tubular member 240 extends from receptacle 626 through the passage 622 of inlet sub 620, forming an annulus 630 between the outer surface 244 of inner tubular member 240 and the inner surface 624 of inlet sub 620, where annulus 630 forms a portion of the inlet flowpath 205 of drill string 200'. In the embodiment shown in FIGS. 8 and 9, inlet sub 620 additionally includes a radial port or conduit 632 extending from the annulus 630 formed in passage 622, where radial port 632 is in selective fluid communication with inlet conduit 104 of surface system 102. Particularly, radial port 632 includes a concentric valve 634 therein for providing selective isolation between annulus 630, and thus inlet flowpath 205 of drill string 200', and inlet conduit 104 of surface system 102. As with concentric valve 608 of return sub 602 discussed above, in the embodiment shown in FIG. 9, concentric valve 634 comprises a concentric ball valve; however, in other embodiments, concentric valve 634 may comprise other types of valves known in the art.

Figure 10:
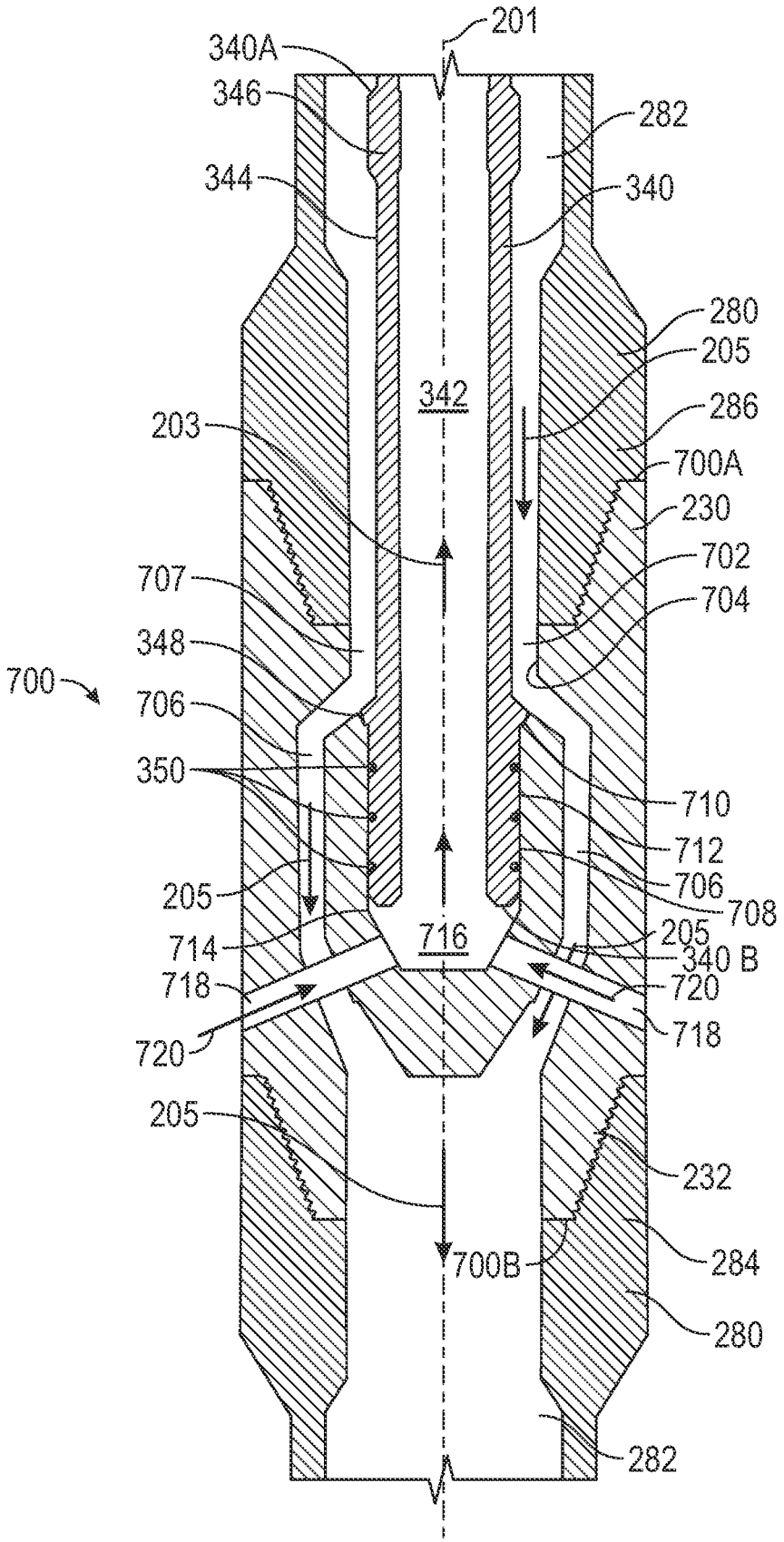
FIG. 10 is a side cross-sectional view of an embodiment of a crossover sub of the well system of FIG. 8 in accordance with principles disclosed herein.

Referring to FIGS. 8 and 10, as discussed above with respect to FIG. 8, in this embodiment drill string 200' includes crossover sub 700 in lieu of the concentric valve 400 for providing fluid communication between wellbore 4 (particularly annulus 12 formed in wellbore 4) and the recirculation flowpath 203 extending through drill string 200'. However, in some embodiments, crossover sub 700 may be employed in drill string 200 of drilling system 100, while in other embodiments concentric valve 400 may be employed with drill string 200' of drilling system 500.

In the embodiment shown in FIGS. 8 and 10, crossover sub 700 has a first or upper end 700A, a second or lower end 700B, a central bore or passage 702 extending between ends 700A and 700B and defined by a generally cylindrical inner surface 704. Crossover sub 700 additionally includes a plurality of circumferentially spaced bypass passages 706 extending between a portion of passage 702 disposed proximal upper end 700A and a portion of passage 702 disposed proximal lower end 700B. In this manner, bypass passages 706 provide for fluid flow between an annulus 707 of crossover sub 700 (formed between the inner surface 704 of sub 700 and an outer surface 344 of an inner tubular member 340 extending into the upper end 700A of crossover sub 700) and the portion of passage 702 disposed at lower end 7006.

In this embodiment, crossover sub 700 also includes a centrally disposed receptacle 708 around which bypass passages 706 extend (at least a portion of each passage 706 being radially offset from central axis 201), thereby allowing fluid flowing along inlet flowpath 205 to bypass or flow around receptacle 708. Receptacle 708 includes an annular landing shoulder or profile 710 formed at an upper end thereof for engaging the corresponding landing profile 348 of inner tubular member 340 such that member 348 may be stabbed into receptacle 708. Receptacle 708 additionally includes a generally cylindrical sealing surface 712 for sealingly engaging the seal assembly 350 of inner tubular member 340, which may comprise, in some embodiments, a gastight seal formed therebetween. Receptacle 708 further includes a frustoconical termination 714 at a lower end thereof, forming a chamber 716 within receptacle 708. In some embodiments, termination 714 is axially spaced from the lower end 340B of inner tubular member 340 to account for potential changes in axial length of the drill string 200' during operation.

In the embodiment shown in FIGS. 8 and 10, crossover sub 700 additionally includes a plurality of circumferentially spaced angled or radial ports 718 that extend between chamber 716 of receptacle 70 and an outer cylindrical surface of crossover sub 700. Radial ports 718 are angularly or circumferentially spaced from bypass passages 706, and thus, fluid communication is restricted between radial ports 718 and passages 706. In this arrangement, a radial fluid return flowpath 720 is established that flows from annulus 12 of wellbore 4 through radial ports 718, and from ports 718 into chamber 716 of receptacle 708 and the passage 342 of inner tubular member 340. In this manner, fluid flow from annulus 12 is provided to recirculation flowpath 203 via radial return flowpath 720. At the same time, the sealing engagement between sealing surface 712 of receptacle 708 and seal assembly 350 inner tubular member 340 restricts fluid communication between radial return flowpath 720 and inlet flowpath 205 of drill string 200'.

While exemplary embodiments have been shown and described, modifications thereof can be made by one skilled in the art without departing from the scope or teaching herein. The embodiments described herein are exemplary only and are not limiting. Many variations and modifications of the system and apparatus are possible and will become apparent to those skilled in the art once the above disclosure is fully appreciated. For example, the relative dimensions of various parts, the materials from which the various parts are made, and other parameters can be varied. Furthermore, thought the openings in the plate carriers are shown as circles, they may include other shapes such as ovals or squares. Accordingly, it is intended that the following claims be interpreted to embrace all such variations and modifications.

What is claimed is:

1. A concentric valve positionable in a wellbore, comprising:

a valve body comprising an outer surface and a central passage, a receptacle disposed in the central passage and defining a chamber disposed therein, and a radial port extending between the receptacle and the outer surface to provide fluid communication between the chamber of the receptacle and an environment surrounding the concentric valve;

an inner tubular member received in the receptacle of the valve body, wherein the inner tubular member comprises an internal fluid passage and a seal assembly configured to sealingly engage an inner surface of the receptacle; and a bypass passage extending around the receptacle of the valve body and circumferentially spaced from the radial port, wherein the bypass passage provides fluid communication between a first end of the central passage and a second end of the central passage opposite the first end and wherein fluid communication is restricted between the bypass passage and the radial port.

2. The concentric valve of claim 1, further comprising a piston slidably disposed in the receptacle of the valve body, wherein the piston comprises a first position providing for fluid communication between the chamber of the valve body and the surrounding environment, and a second position restricting fluid communication between the surrounding environment and the chamber.

3. The concentric valve of claim 2, further comprising a biasing member configured to bias the piston towards the second position.

4. The concentric valve of claim 2, wherein the piston is configured to actuate into the second position in response to the ceasing of fluid flow through the internal fluid passage of the inner tubular member.

5. The concentric valve of claim 2, wherein the piston comprises a radial port in fluid communication with the radial port of the valve body when the piston is in the first position.

6. The concentric valve of claim 1, wherein the concentric valve comprises a plurality of the bypass passages which are circumferentially spaced from each other and the radial port.

7. A concentric valve positionable in a wellbore, comprising:

a valve body comprising an outer surface and a central passage, a receptacle disposed in the central passage and defining a chamber disposed therein, and a radial port extending between the receptacle and the outer surface to provide fluid communication between the chamber of the receptacle and an environment surrounding the concentric valve;

an inner tubular member slidingly received in the receptacle of the valve body whereby an outer surface of the inner tubular member is unattached from an inner surface of the receptacle, wherein the inner tubular member comprises an internal fluid passage and a seal assembly configured to sealingly engage an inner surface of the receptacle; and a piston slidably disposed in the receptacle of the valve body, wherein the piston comprises a first position providing for fluid communication between the chamber of the valve body and the surrounding environment, and a second position restricting fluid communication between the surrounding environment and the chamber.

8. The concentric valve of claim 7, further comprising a bypass passage extending around the receptacle of the valve body, wherein the bypass passage provides fluid communication between a first end of the central passage and a second end of the central passage opposite the first end.

9. The concentric valve of claim 8, wherein the bypass passage is circumferentially spaced from the radial port.

10. The concentric valve of claim 8, further comprising a plurality of the bypass passages which are circumferentially spaced from each other and the radial port.

11. The concentric valve of claim 8, wherein the piston is configured to actuate into the first position in response to fluid pressure in the inlet flowpath extending through the bypass passage being greater than fluid pressure in a recirculation flowpath extending through the radial port.

12. The concentric valve of claim 7, further comprising a biasing member configured to bias the piston towards the second position.

13. The concentric valve of claim 7, wherein the piston comprises a radial port in fluid communication with the radial port of the valve body when the piston is in the first position.

14. A concentric valve positionable in a wellbore, comprising:

a valve body comprising an outer surface and a central passage, a receptacle disposed in the central passage and defining a chamber disposed therein, and a radial port extending between the receptacle and the outer surface to provide fluid communication between the chamber of the receptacle and an environment surrounding the concentric valve;

an inner tubular member received in the receptacle of the valve body, wherein the inner tubular member comprises an internal fluid passage and a seal assembly configured to sealingly engage an inner surface of the receptacle; and a plurality of circumferentially spaced bypass passages extending around the receptacle of the valve body and each circumferentially spaced from the radial port, wherein the bypass passage provides fluid communication between a first end of the central passage and a second end of the central passage opposite the first end.

15. The concentric valve of claim 14, further comprising a piston slidably disposed in the receptacle of the valve body, wherein the piston comprises a first position providing for fluid communication between the chamber of the valve body and the surrounding environment, and a second position restricting fluid communication between the surrounding environment and the chamber.

16. The concentric valve of claim 15, further comprising a biasing member configured to bias the piston towards the second position.

17. The concentric valve of claim 15, wherein the piston is configured to actuate into the second position in response to the ceasing of fluid flow through the internal fluid passage of the inner tubular member.

18. The concentric valve of claim 15, wherein the piston comprises a radial port in fluid communication with the radial port of the valve body when the piston is in the first position.

19. The concentric valve of claim 14, wherein fluid communication is restricted between the bypass passage and the radial port.

* * * * *